United States Patent [19]

Sakamoto

[11] Patent Number: 4,961,527

[45] Date of Patent: Oct. 9, 1990

[54] PAPER TRANSPORTING TRACTOR FOR PRINTERS

[75] Inventor: Teruo Sakamoto, Chigasaki, Japan

[73] Assignee: Ricoh Company, Ltd., Tokyo, Japan

[21] Appl. No.: 825,951

[22] Filed: Feb. 4, 1986

Related U.S. Application Data

[63] Continuation of Ser. No. 536,336, Sep. 27, 1983.

[30] Foreign Application Priority Data

Sep. 27, 1982 [JP] Japan ..... 57-168066

[51] Int. Cl.[5] ..... B65H 20/22

[52] U.S. Cl. ..... 226/74

[58] Field of Search ..... 226/74, 75, 170, 171, 226/172; 400/618.2

[56] References Cited

U.S. PATENT DOCUMENTS

| | | | |
|---|---|---|---|
| 3,367,549 | 2/1968 | Assony | 226/74 |
| 3,669,327 | 6/1972 | Dowd | 226/74 X |
| 3,915,291 | 10/1975 | Vogts | 226/172 X |
| 4,194,660 | 3/1980 | Seitz | 226/74 |
| 4,199,091 | 4/1980 | Hubbard | 226/74 |
| 4,226,353 | 10/1980 | Blaskovic et al. | 226/74 |
| 4,316,567 | 2/1982 | Grear et al. | 226/74 |
| 4,412,637 | 11/1983 | Berger | 226/74 X |
| 4,413,764 | 11/1983 | Weber et al. | 226/74 X |
| 4,421,261 | 12/1983 | Hubbard | 226/74 |

FOREIGN PATENT DOCUMENTS

| | | | |
|---|---|---|---|
| 656593 | 1/1963 | Canada | 226/170 |

*Primary Examiner*—Harvey O. Hornsby
*Assistant Examiner*—Scott J. Haugland
*Attorney, Agent, or Firm*—Cooper & Dunham

[57] ABSTRACT

A paper transporting tractor for transporting paper provided with sprocket holes at an equally spaced interval along either side thereof includes a first endless belt having a plurality of sprockets at its outer peripheral surface and a serrated portion at its inner peripheral surface, a driving gear which is in mesh with the serrated portion of the belt thereby causing the belt to move either forward or backward, an end guide portion provided as spaced apart from the driving gear to provide the first endless belt as extended between the gear and the end guide portion and a second endless belt of thin film provided around the end guide portion as sandwiched between the first endless belt and the end guide portion at least partly thereby allowing to substantially decrease the friction between the first endless belt and the end guide portion.

24 Claims, 2 Drawing Sheets

PAPER TRANSPORTING TRACTOR FOR PRINTERS

This is a continuation application from application Ser. No. 536,336 filed Sept. 27, 1983, now abandoned.

BACKGROUND OF THE INVENTION

1. Field of the Invention

This invention generally relates to paper transporting devices for use in printers, and, in particular, to a paper transporting tractor of a tractor type paper transporting assembly.

2. Description of the Prior Art

A tractor type paper transporting assembly for transporting continuous, lengthy paper provided with sprocket holes on both sides at equally spaced intervals is well known in the art. As shown in FIG. 1, such a tractor type paper transporting assembly includes a pair of paper transporting tractors 1, 1 which are disposed generally above the body of a printer 2 as spaced apart from each other over a distance corresponding to the width of continuous paper to be transported as passed around a platen roller 3. As also shown in FIG. 2, these paper advancing tractors 1, 1 are supported to be slidable along a driving shaft 6 and a supporting shaft 7 so as to be able to be located on both sides of paper, which is provided with sprocket holes 4, 4 along both sides at equally spaced intervals, according to its width. Each of these tractors 1, 1 includes an endless belt or chain 8 which is provided with pins 9 on its outer peripheral surface at equally spaced intervals so as to be engageable with the sprocket holes 4 of the corresponding side of paper 5. Although not shown specifically, the inner peripheral surface of the belt 8 is serrated and the serrated inner surface is in mesh with a driving gear integrally mounted on the driving shaft 6. The tractor 1 also includes a pair of pivotally provided upper and lower pressure plates 10 and 11 for keeping the sprocket holes 4 of the paper 5 engaged with the pins 9.

In operation, the upper and lower pressure plates 10 and 11 are pivoted to be open and the paper 5 is placed in position with its sprocket holes 4 and 4 engaged with the corresponding pins 9 and 9, respectively. Then, the upper and lower pressure plates 10 and 11 are closed to complete setting of the paper 5. Thus, as printing proceeds, the driving shaft 6 is driven to rotate over a predetermined angle upon completion of printing of each line thereby causing the paper 5 to advance intermittently in the paper advancing or feeding direction.

However, it is often required to pull back the paper 5 in the direction opposite to the paper advancing direction over a certain distance before resumption of printing operation. In such a case, use of an endless chain 8 is disadvantageous because a clearance in the chain will cause to deteriorate the printing quality when such an endless chain is moved back and forth. Use has also been made of an endless belt of synthetic rubber such as urethane; however, it tends to become slackened when it is moved back and forth thereby causing the quality of printing to be deteriorated. It has been proposed to provide such an endless belt in high tension so as to remove any slack, but this then will require an increased driving power due mainly to an increase in frictional force with its guide members.

SUMMARY OF THE INVENTION

The disadvantages of the prior art as described above are obviated by the present invention and an improved paper advancing tractor is hereby provided.

Therefore, it is a primary object of the present invention to provide an improved paper advancing tractor.

Another object of the present invention is to provide a paper advancing tractor which allows to provide an endless belt provided with sprockets on its outer peripheral surface without any slack without requiring an increase in driving power.

A further object of the present invention is to provide a paper advancing tractor capable of advancing paper in either forward or backward direction without causing deterioration in printing characteristics.

A still further object of the present invention is to provide an improved paper advancing tractor which is yet simple in structure and thus easy to manufacture, thereby allowing to keep its cost at low level.

Other objects, advantages and novel features of the present invention will become apparent from the following detailed description of the invention when considered in conjunction with the accompanying drawings.

DESCRIPTION OF THE PREFERRED EMBODIMENTS

Figure 1:
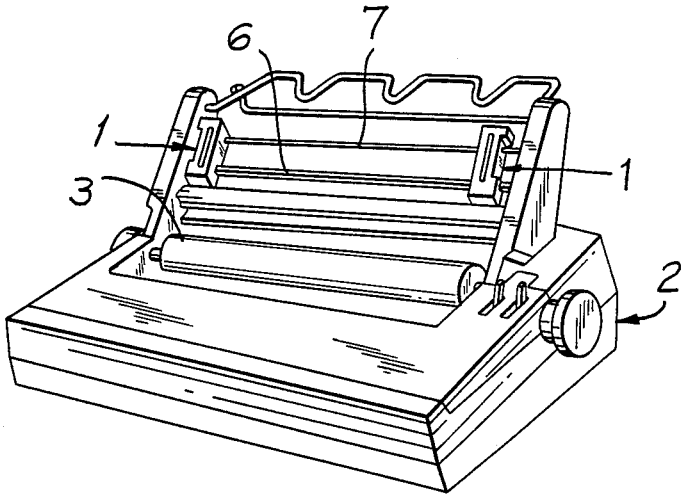
FIG. 1 PRIOR ART
FIG. 1 is a perspective view showing the overall structure of a printer provided with a tractor type paper advancing assembly on top.
Figure 2:
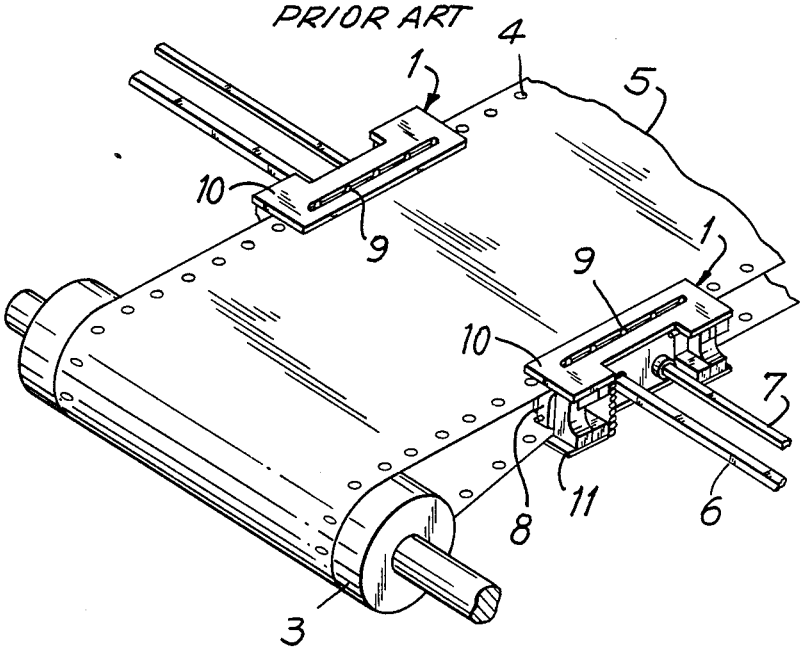
FIG. 2 PRIOR ART
FIG. 2 is a perspective view showing the state in which paper is set in position in the paper advancing tractors of the tractor type paper advancing assembly shown in FIG. 1.
Figure 3:
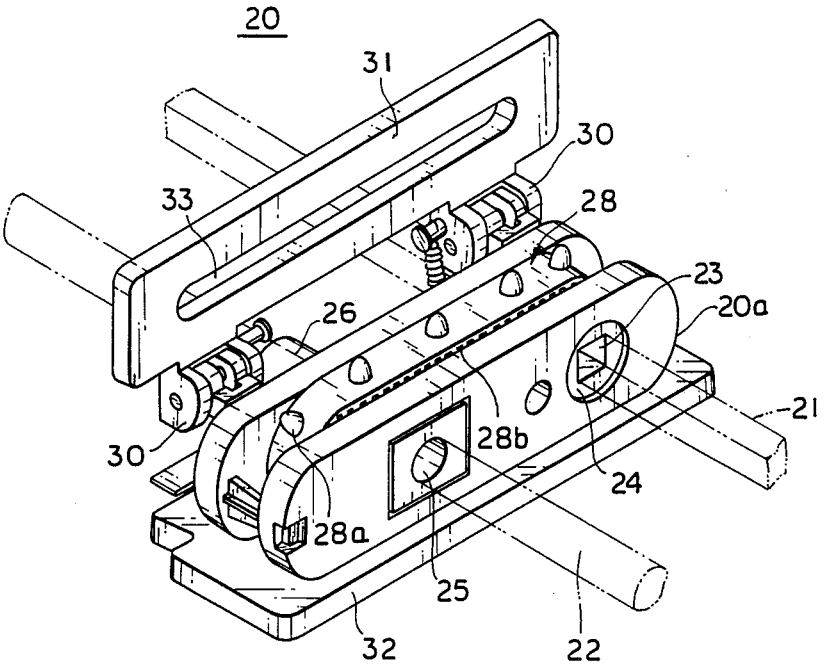
FIG. 3 is a perspective view showing the paper advancing tractor constructed in accordance with one embodiment of the present invention with its upper pressure plate pivoted open.
Figure 4:
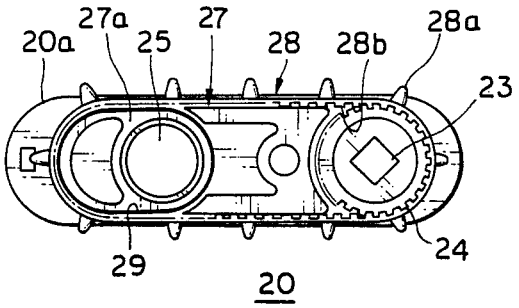
FIG. 4 is a longitudinal cross sectional view of the paper advancing tractor shown in FIG. 3.

Referring now to FIG. 3, there is shown the overall structure of a paper advancing tractor 20 constructed in accordance with one embodiment of the present invention. As shown, the tractor 20 is provided as slidably supported on a driving shaft 21 and a supporting shaft 22 which are held by a housing ( not shown ) of a tractor paper advancing assembly on both ends. As shown, the driving shaft 21 is rectangular in cross section and is rotatably held by the housing. As shown in FIG. 4, the driving shaft 21 is fitted into a rectangularly shaped center hole 23 of a driving gear 24 which is disposed between a pair of side plates **20*a*, and, thus, the driving gear 24 rotates in unison with the driving shaft 21 when the driving shaft 21 is driven to rotate by an appropriate driving means ( not shown ). On the other hand, the supporting shaft 22 passes through a through-hole 25 provided in the side plate 20*a*. As shown in FIG. 3, a clamp 26 is provided on the supporting shaft 22 for securely holding the tractor 20 in position at a desired position of the supporting shaft 22**.

As shown in FIG. 4, also provided between the pair of side plates **20*a*, 20*a* is a center guide portion 27 having upper and lower straight guide surfaces, which is disposed adjacent to the driving gear 24. An end guide portion 27*a* is also provided as sandwiched between the pair of side plates 20*a*, 20*a* and adjacent to the center guide portion at the side opposite to the side where the driving gear 24 is provided. In the illustrated embodiment, the end guide portion 27***a* has a generally oval-shaped outer peripheral surface defined by a pair of opposed straight surfaces and a pair of opposed semicircular surfaces. It is to be noted that the straight surfaces of the end guide portion 27*a* are aligned with the straight guide surfaces of the center guide portion 27. It should also be noted that a gap is provided between the center guide portion 27 and the end guide portion 27*a*.

An endless driving belt 28 is provided to extend between the driving gear 24 and the end guide portion 27*a*. The endless driving belt 28 has pins 28*a* as provided at its outer peripheral surface at an equal interval, and the inner peripheral surface of the belt 28 is serrated as indicated by the numeral 28*b* so as to be engageable with the gear 24. Of importance, as shown in FIG. 4, another endless belt 29 of thin film is provided as fitted onto the track-shaped end guide portion 27*a* such that it can slidingly move around the outer peripheral surface of the end guide portion 27*a*. The thin film endless belt 29 is provided to reduce a friction between the end guide portion 27*a* and the driving belt 28. Preferably, the thin film endless belt 29 is comprised of a material such as polyimide, teflon, etc. and the selection of a material for this thin film endless belt should be made mainly from the viewpoint of reducing the friction between the driving belt 28 and the end guide portion 27*a*.

The tractor 20 is also provided with upper and lower pressure plates 31 and 32 hinged at 30 to one of the side plates 20*a* so as to be pivoted to be open or closed. Each of these upper and lower pressure plates 31 and 32 is provided with a viewing window 33 in the form of a slot such that the pins 28*a* of the driving belt 28 may be observed from the exterior even if the pressure plates 31 and 32 are closed.

In operation, a pair of tractors 20 are slidably moved along the driving and supporting shafts 21 and 22 to be located at desired positions according to the width of paper to be used. After having the pair of tractors 20 located at desired positions, the lower pressure plate 32 is pivoted open and move the paper closer to the bottom side of the tractor 20 thereby bringing the sprocket holes of the paper in engagement with the pins 28*a* of the driving belt 28. Then the lower pressure plate 32 is pivoted to the closed position thereby causing the paper to be sandwiched between the lower pressure plate 32 and the driving belt 28. Thus, the driving shaft 21 is caused to rotate by means of a driving source such as a motor ( not shown ) so that the driving belt 28 is driven to move through the driving gear 24 thereby causing the paper to advance toward the platen roller 3. Accordingly the paper moves around the platen roller 3 to again move toward the tractor 20, so that the upper pressure plate 31 is now pivoted open and the paper thus fed is set in position by causing its sprocket holes 4 to be engaged with the pins 28*a* of the driving belt 28. Then the upper pressure plate 31 is pivoted to the closed position to securely maintain the engagement between the pins 28*a* and the sprocket holes 4, thereby completing loading of paper to the tractors 20 to set ready for printing operation.

Thus, as printing proceeds, the driving shaft 21 is driven to rotate over a desired angle after completing printing of a line to cause the paper to advance to the next printing line. With the paper advancing tractors 20 as described above, even if the paper is moved in the forward or backward direction as desired, since the driving belt 28 can move smoothly in either direction, there will be no deterioration in the quality of printed characters. Because, as described above, the auxiliary endless belt 29 is so structured to reduce friction between the driving endless belt 28 and the end guide portion 27*a*. It is preferably so structured to reduce not only the friction between the driving endless belt 28 and the auxiliary endless belt 29 but also the friction between the auxiliary endless belt 29 and the end guide portion 27*a*. However, if a sufficient reduction in friction is obtained between in either case due, for example, to proper selection of a material, the auxiliary endless belt 29 may be provided to be stationary or movable with respect to the end guide portion 27*a*.

In this manner, in accordance with the present invention, the driving endless belt is so provided to extend between the driving gear and the auxiliary endless belt, the driving belt can move in either forward or backward direction to cause the paper to advance in a desired direction without producing any slack and/or requiring an additional driving power. Consequently, the paper may be moved smoothly in either direction and the quality of printed characters may be maintained at high level.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claim is:

1. A tractor feed device for feeding a paper sheet by engaging with sprocket holes provided along at least one side of the sheet, comprising:

a first endless belt having an outer peripheral surface provided with pins for engagement with the sprocket holes of the paper sheet and an inner surface provided with serrations, said first belt being extended to have opposed ends of its inner surface looped over a first guide means and a drive means, the first guide means being stationary with respect to movement of the first belt, spaced apart from the drive means and including a first through-hole for receiving therein a first shaft, the drive means including a toothed wheel engaged with the serrated inner surface of the first belt and having a second through-hole for receiving therein a second shaft; and a second endless belt, which has smooth and unperforated inner and outer surfaces, looped around said first guide means and interposed between an outer peripheral surface of said first guide means and the inner surface of said first belt, said second belt being made of a low friction material such that it reduces friction between said first between said first belt and said first guide means and being not in mechanical mesh with said first belt.

2. A device of claim 1 further comprising a pair of side plates between which said driving means and said first guide means are disposed.

3. A device of claim 2 further comprising second guide means disposed between said driving means and said first guide means, said second guide means including upper and lower straight guide surfaces to guide the movement of said first endless belt.

4. A device of claim 3 wherein said first guide means includes a generally oval-shaped outer peripheral guide surface around which said second endless belt is provided.

5. A device of claim 4 wherein said oval-shaped outer peripheral surface includes a pair of opposed upper and lower straight surfaces which are aligned with said upper and lower guide surfaces of said second guide means and a pair of opposed semi-circular guide surfaces each connecting the ends of said opposed upper and lower straight surfaces.

6. A device of claim 3 wherein said second endless belt is a thin film endless belt.

7. A tractor feed device according to claim 1 wherein said second belt is made of a material which also slides easily on the inner surface of said first endless belt.

8. A device of claim 7 wherein said material is selected from the group consisting of polyimide and polytetrafluorethylene.

9. A device of claim 1 wherein said first endless belt is comprised of urethane.

10. A paper feeder for feeding paper provided with sprocket holes at equally spaced intervals along both sides thereof including supporting means and a pair of tractor-feed assemblies which are mounted on said supporting means so as to be adjustable in position, wherein each of said tractor-feed assemblies comprises:

a first endless belt having a plurality of pins engageable with said sprocket holes provided on its outer peripheral surface at similarly equally spaced intervals and first engaging means, said first endless belt being extended to have opposed ends at first and second positions defined along a path for transporting paper and spaced apart from each other;

driving means located at said first position and having second engaging means engageable with said first engaging means, said driving means including a driving through-hole for receiving therein a driving shaft and being capable of driving said first endless belt in a predetermined direction;

first guide means provided stationary at said second position and spaced apart from said driving means to support said first endless belt which is extended between said driving means at said first position and said first guide means at said second position, said first guide mans including a supporting hole for receiving therein a supporting shaft; and a second endless belt, which has smooth and unperforated inner and outer surfaces, provide around said first guide means sandwiched between said first endless belt and said first guide means at least partly, said second endless belt being comprised of a material which provides a reduction in friction between said first endless belt and said first guide means and being not in mechanical mesh with said first belt.

11. A paper feeder of claim 10 wherein aid supporting means includes a pair of first and second shafts which extend in parallel and wherein said driving means includes a first hole through which said first shaft slidably extends and said first guide means includes a second hole through which said second shaft slidably extends, whereby said driving means rotate together with said first shaft.

12. A paper feeder of claim 11 wherein said first shaft is non-circular in cross section and said first hole has a corresponding non-circular shape; whereas, said second shaft is circular in cross section and said second hole has a corresponding circular shape.

13. A paper feeder of claim 12 wherein said first shaft is a driving shaft which is driven to rotate thereby causing said driving means to drive to move said first endless belt.

14. A device of claim 10 further comprising a pair of side plates between which said driving means and said first guide means are disposed.

15. A device of claim 14 further comprising second guide means disposed between said driving means and said first guide means, said second guide means including upper and lower straight guide surfaces to guide the movement of said first endless belt.

16. A device of claim 15 wherein said first engaging means includes a serrated portion provided on said first endless belt, and said driving means includes a gear which is in mesh with the serrated portion of said first endless belt.

17. A device of claim 16 wherein said serrated portion is provided at the inner peripheral surface of said first endless belt.

18. A device of claim 15 wherein said first guide means includes a generally oval-shaped outer peripheral guide surface around which said second endless belt is provided.

19. A device of claim 18 wherein said oval-shaped outer peripheral surface includes a pair of opposed upper and lower straight surfaces which are aligned with said upper and lower guide surfaces of said second guide means and a pair of opposed semi-circular guide surfaces each connecting the ends of said opposed upper and lower straight surfaces.

20. A device of claim 15 wherein said second endless belt is a thin film endless belt.

21. A device of claim 20 wherein said thin film endless belt is comprised of a material which allows sliding of said first endless belt over said first guide means at low friction.

22. A device of claim 21 wherein said material is selected from the group consisting of polyimide and polytetrafluorethylene.

23. A device of claim 10 wherein said first endless belt is comprised of urethane.

24. A printer including the paper feeder of claim 10.

* * * * *